US007793933B2

(12) United States Patent
Morimoto et al.

(10) Patent No.: US 7,793,933 B2
(45) Date of Patent: Sep. 14, 2010

(54) DRIVE TRANSMISSION MECHANISM OF SHEET TRANSPORTATION APPARATUS AND DOCUMENT TRANSPORTATION APPARATUS

(75) Inventors: Yasumasa Morimoto, Kashihara (JP); Hirotoshi Iemura, Nara (JP); Shinichiro Hiraoka, Yamatokoriyama (JP); Sohichi Takata, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/355,855

(22) Filed: Jan. 19, 2009

(65) Prior Publication Data

US 2009/0184462 A1 Jul. 23, 2009

(30) Foreign Application Priority Data

Jan. 22, 2008 (JP) ..... 2008-012036

(51) Int. Cl.
*B65H 5/00* (2006.01)

(52) U.S. Cl. ..... 271/264; 271/10.11; 399/124

(58) Field of Classification Search ..... 271/264, 271/10.04, 10.11, 266, 272, 273; 399/124
See application file for complete search history.

(56) References Cited

U.S. PATENT DOCUMENTS 5,876,032 A * 3/1999 Kato ..... 271/114
5,988,630 A * 11/1999 Kawaura ..... 271/161
6,811,151 B2 * 11/2004 Wei-Feng et al. ..... 271/10.03
6,877,737 B2 * 4/2005 Yanagi et al. ..... 271/121
7,116,926 B2 * 10/2006 Tsusaka ..... 399/124

FOREIGN PATENT DOCUMENTS

| | | |
|---|---|---|
| JP | 07-125873 | 5/1995 |
| JP | 08-285034 | 11/1996 |
| JP | 09-216747 | 8/1997 |
| JP | 10-203659 | 8/1998 |

* cited by examiner

*Primary Examiner*—Kaitlin S Joerger
(74) *Attorney, Agent, or Firm*—Renner, Otto, Boisselle & Sklar, LLP

(57) ABSTRACT

A drive transmission mechanism of a sheet transportation apparatus of the present invention comprises an upstream transportation roller gear and a planet gear for transmitting a first driving force from a driving source to the upstream transportation roller gear, and a release mechanism for preventing the upstream transportation roller gear and the planet gear from engaging with each other. The release mechanism prevents the engagement of the planet gear and the upstream transportation roller gear when the driven gear is driven to reversely rotate by a second driving force. The release mechanism prevents the engagement by moving a release member before the planet gear and the driven gear engage with each other. The release mechanism moves the release member by the driven gear being reversely rotated by the second driving force which is a driving force other than the driving source. This makes it possible to realize a drive transmission mechanism of a sheet transportation apparatus comprising a release mechanism capable of releasing the engagement of the driven gear and the drive gear for transmitting the driving force from the driving source to the driven gear, without the need of reversely rotating the driving source or the fear of impairing the driving force from the driving source.

11 Claims, 11 Drawing Sheets

NORMAL TRANSPORTATION

REVERSE TRANSPORTATION

JAM RELEASE

NORMAL TRANSPORTATION

REVERSE TRANSPORTATION

NORMAL TRANSPORTATION

JAM RELEASE

DRIVE TRANSMISSION MECHANISM OF SHEET TRANSPORTATION APPARATUS AND DOCUMENT TRANSPORTATION APPARATUS

This Nonprovisional application claims priority under U.S.C. §119(a) on Patent Application No. 012036/2008 filed in Japan on Jan. 22, 2008, the entire contents of which are hereby incorporated by reference.

FIELD OF THE INVENTION

The present invention relates to a drive mechanism for transmitting a driving force from a drive gear to a driven gear, and more particularly to a drive transmission mechanism of a sheet transportation apparatus for transporting a sheet, such as a document, a recording paper and the like.

BACKGROUND OF THE INVENTION

Conventionally, an image forming apparatus, such as a copying machine, a facsimile, a printer, a multifunction printer and the like, or a scanner and the like, transports a sheet, such as a paper, a document or the like by sandwiching the sheet between a pair of transportation rollers, which face each other, and rotating the transportation rollers.

Such transportation rollers are rotated by a driving force being transmitted from a driving source to a transportation roller gear via a drive gear so as to carry a sheet sandwiched between the transportation rollers in a direction in which opposed parts of the transportation rollers are moved.

In a configuration where a sheet is transported by rotation of transportation rollers, constant engagement of a drive gear and a transportation roller gear causes such a problem when a sheet is jammed that even if a user tries to remove the sheet, the removal of the sheet is difficult because a driving source prevents the transportation rollers from reversely rotating.

As a solution to such a problem, Patent Document 1 discloses two release mechanisms. In the release mechanism, an intermediate gear is provided between a drive gear and a driven gear. The release mechanism contacts the intermediate gear with the driven gear only at the time of drive, so as to transmit a driving force of the drive gear to the driven gear. At the time of nondrive, the release mechanism disengages the intermediate gear away from the driven gear.

In a first release mechanism, an intermediate gear is supported rotatably about a rotation center of a drive gear. When the drive gear is forwardly rotated, the intermediate gear engages with a driven gear by a rotation force generated by a pressure angle. When the drive gear is reversely rotated, the engagement of the intermediate gear with the driven gear is released by a rotation force generated by a pressure angle.

Furthermore, in a second release mechanism, an intermediate gear is supported rotatably about a rotation center of a drive gear. Further, the intermediate gear is provided with an elastic means for urging a pulling force in a direction where the engagement of the intermediate gear with the driven gear is released. When the drive gear is forwardly rotated, the intermediate gear engages with a driven gear by a rotation force generated by a pressure angle. When the drive gear is suspended, the engagement of the intermediate gear with the driven gear is released by a pulling force of the elastic means.

The arrangement in which the engagement of the intermediate gear with the driven gear is released at the time of nondrive enables a transportation roller provided on the driven gear to rotate reversely as well. This makes it possible to remove a sheet.

[Patent Document 1] Japanese Unexamined Patent Application Publication, Tokukaihei, No. 8-285034 (Published on Nov. 1, 1996)

However, the aforementioned release mechanism provided in the conventional drive transmission mechanism has the following problems.

In the first release mechanism, it is necessary to reversely rotate the driving source in order to release the engagement of the intermediate gear (drive gear) for transmitting the driving force from the driving source with the driven gear.

However, the driving source frequently transmits the driving force to the other units as well. Therefore, it is sometimes impossible to reversely rotate the driving source in connection with the other units. In such case, the first release mechanism cannot be adopted.

In the second release mechanism, on the other hand, it is unnecessary to reversely rotate the driving source. However, there is a problem that the driving force from the driving source is impaired because the mechanism is configured to constantly resist the pulling force of the elastic means so as to transmit the driving force to the driven gear.

SUMMARY OF THE INVENTION

It is an object of the present invention to provide a drive transmission mechanism of a sheet transportation apparatus comprising a release mechanism capable of releasing engagement of a driven gear and a drive gear for transmitting a driving force from a driving source to the driven gear, without the need of reversely rotating the driving source or the fear of impairing the driving force from the driving source, and to provide a document transportation apparatus using the drive transmission mechanism.

In order to attain the aforementioned object, a drive transmission mechanism of a sheet transportation apparatus of the present invention comprises a driven gear, a planet gear for transmitting a first driving force from a driving source to the driven gear by engagement with the driven gear, and a release mechanism for preventing the planet gear and the driven gear from engaging with each other when the driven gear is driven to reversely rotate by a second driving force. The release mechanism prevents the engagement by moving a release member before the planet gear and the driven gear engage with each other. The release mechanism moves the release member by the driven gear being reversely rotated by the second driving force which is a driving force other than the first driving force.

According to this, the release mechanism is configured to prevent the planet gear and the driven gear from engaging with each other when the driven gear is driven to reversely rotate by the second driving force. The release mechanism prevents the engagement by moving a release member before the planet gear and the driven gear engage with each other. The release mechanism moves the release member by the driven gear being reversely rotated by a second driving force which is a driving force other than the first driving force obtained from the driving source.

Therefore, it is possible to release the engagement of the driven gear and the drive gear for transmitting the driving force from the driving source to the driven gear, without the need of reversely rotating the driving source or the fear of impairing the driving force from the driving source.

In order to attain the aforementioned object, a document transportation apparatus of the present invention comprises a document tray on which to place a document, a feeding roller for feeding the document on the document tray, and a transportation roller for transporting the fed document. The document transportation apparatus, as a drive transmission mechanism of the transportation roller, comprises a driven gear, a planet gear for transmitting a first driving force from a driving source to the driven gear by engagement with the driven gear, and a release mechanism for preventing the planet gear and the driven gear from engaging with each other when the driven gear is driven to reversely rotate by the second driving force. The release mechanism prevents the engagement by moving a release member before the planet gear and the driven gear engage with each other. The release mechanism moves the release member by the driven gear being reversely rotated by a second driving force which is a driving force other than the first driving force.

This makes it possible to easily remove a jammed document by releasing the engagement of the driven gear and the drive gear for transmitting the driving force from the driving source to the driven gear, without the need of reversely rotating the driving source or the fear of impairing the driving force from the driving source.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1(*b*) is an explanatory view showing a drive state of the planet gear apparatus and the upstream transportation roller gear and a state of the release mechanism during reverse transportation in which a drive motor reversely rotates. FIG. 1(*c*) is an explanatory view showing a drive state of the planet gear apparatus and the upstream transportation roller gear and a state of the release mechanism at the time of jam release.

FIG. 6(*b*) is an explanatory view showing a drive state of a planet gear apparatus and an upstream transportation roller gear during reverse transportation in which a drive motor reversely rotates.

FIG. 10(*b*) is an explanatory view showing a drive state of a planet gear apparatus and an upstream transportation roller gear and a state of a release mechanism at the time of jam release.

DESCRIPTION OF THE EMBODIMENTS

Embodiments of the present invention are described below based on FIGS. 1 to 11. Furthermore, the present invention is not limited to these embodiments.

Figure 2:
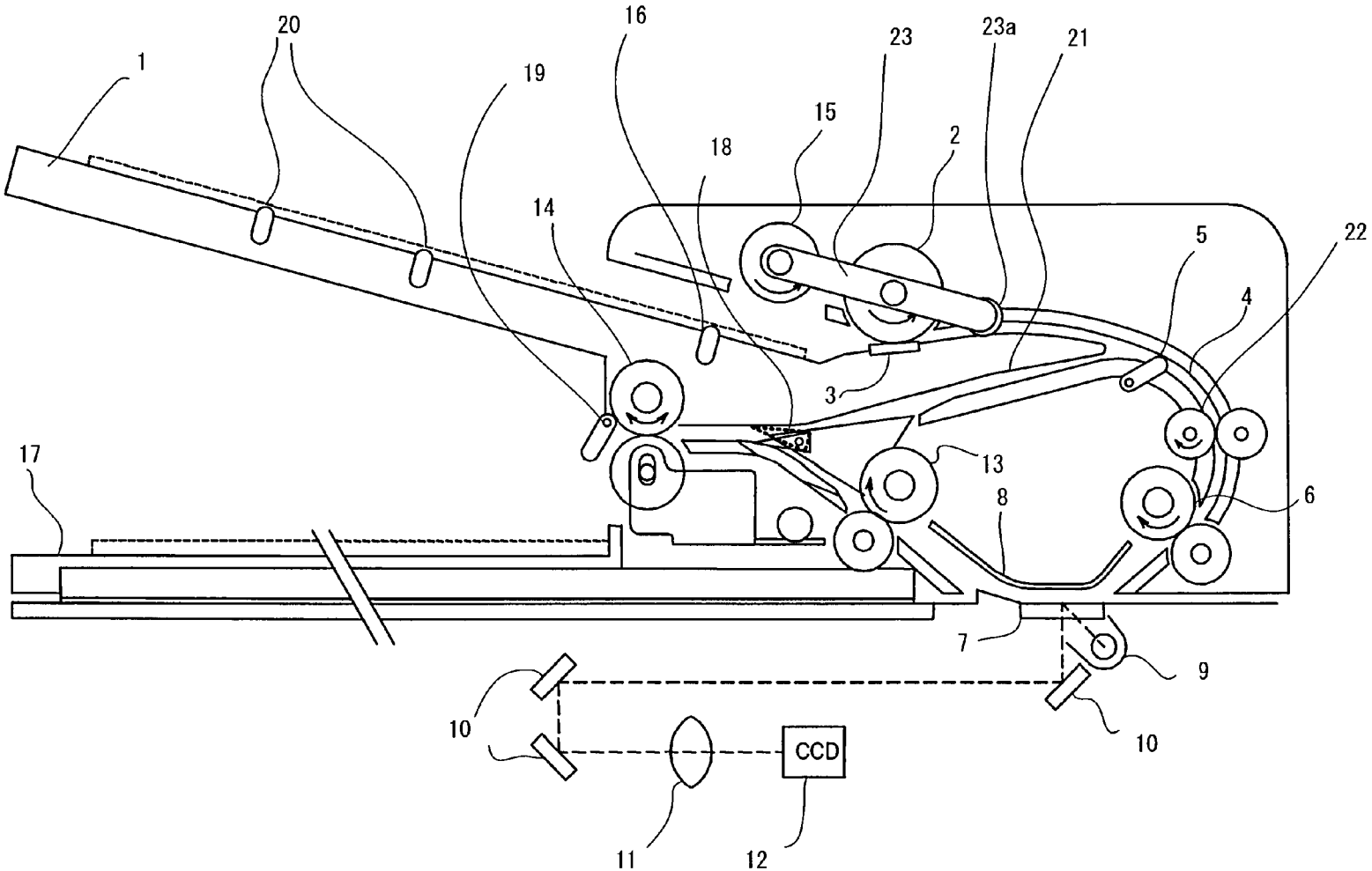
FIG. 2 is a longitudinal cross-sectional view showing a configuration of the document transportation apparatus.

First, referring FIG. 2, one embodiment of a configuration of a document transportation apparatus 100 comprising a drive transmission mechanism of a sheet transportation apparatus is described. FIG. 2 is a longitudinal cross-sectional view showing a configuration of the document transportation apparatus 100.

A document tray 1 is a tray on which to place a document. A document size detection sensor 20 detects a size of a placed document and a document presence detection sensor 16 detects whether a document is placed or not.

A pick roller (feeding roller) 15 provided on one end of a pick arm (arm) 23 feeds the placed document. The pick roller 15 is driven by solenoid (not illustrated). At the time of document feeding, the pick roller 15 is contacted with a top surface of the placed document so as to feed the document at the top of a pile of documents. The fed document is transported between a separation roller 2 and a detachment pad 3. Only the document at the top is sent to a first transportation pathway 4. An end of the document sent to the first transportation pathway 4 is detected by a transportation sensor 5.

Here the pick roller 15, except at the time of document feeding, stands by at an upper position away from a top surface of a document. When the pick roller 15 moves to the upper position, rotation of the pick arm 23 is regulated by abutting the other end of the pick arm 23 against a bottom plate of the first transportation pathway 4. At the other end of the pick arm 23, the pick roller 15 is not provided.

Furthermore, in the document transportation apparatus 100 of the present embodiment, a pick arm roller 23*a* is provided on the pick arm 23 at which end the pick roller 15 is not provided. The pick arm roller 23*a* being provided in this way allows the document to move smoothly because the fed document passes between the other end of the pick arm 23 at which end the pick roller 15 is not provided and the bottom plate of the first transportation pathway 4. Moreover, also in order to clear a paper jam, it is possible to smoothly pull out a jammed document.

The document transported to the first transportation pathway 4 is transported to a registration roller 6 by an upstream transportation roller 22. A front end of the document abuts on the registration roller 6 to be adjusted.

The document having passed through the registration roller 6 is transported along a reading guide 8. When the document passes through a reading glass 7, image information thereof is read. That is, light irradiated from a light source lamp 9 is transmitted through the reading glass 7 and reaches the document. The reflected light therefrom is transmitted through the reading glass 7 again and converged at a lens 11 via a plurality of folded mirrors 10 . . . . Then the light enters a CCD 12, at which the light is converted into image data.

The document having passed over the reading glass 7 is transported to a reversing roller 14 by a downstream transportation roller 13. In the transportation to the reversing roller 14, the document is transported thereto by pushing up, by its own weight, a switching gate 18 in a state of a solid line on the drawing. In the case of one-side reading, the document having passed is directly outputted on a paper output tray 17. In outputting the document, the end of the outputted document is detected by a paper output sensor 19.

In the case of duplex reading, on the other hand, the reversing roller 14 reversely rotates so as to switch the document back. The switched-back document is transported to a second transportation pathway 21 by the switching gate 18 and enters the first transportation pathway 4 again. Then the document is transported to the reading glass 7.

Moreover, in the aforementioned configuration, the downstream transportation roller 13, the registration roller 6, the upstream transportation roller 22 and the reversing roller 14 are all configured to carry a document by sandwiching the document between a pair of rollers, which face each other.

Figure 3:
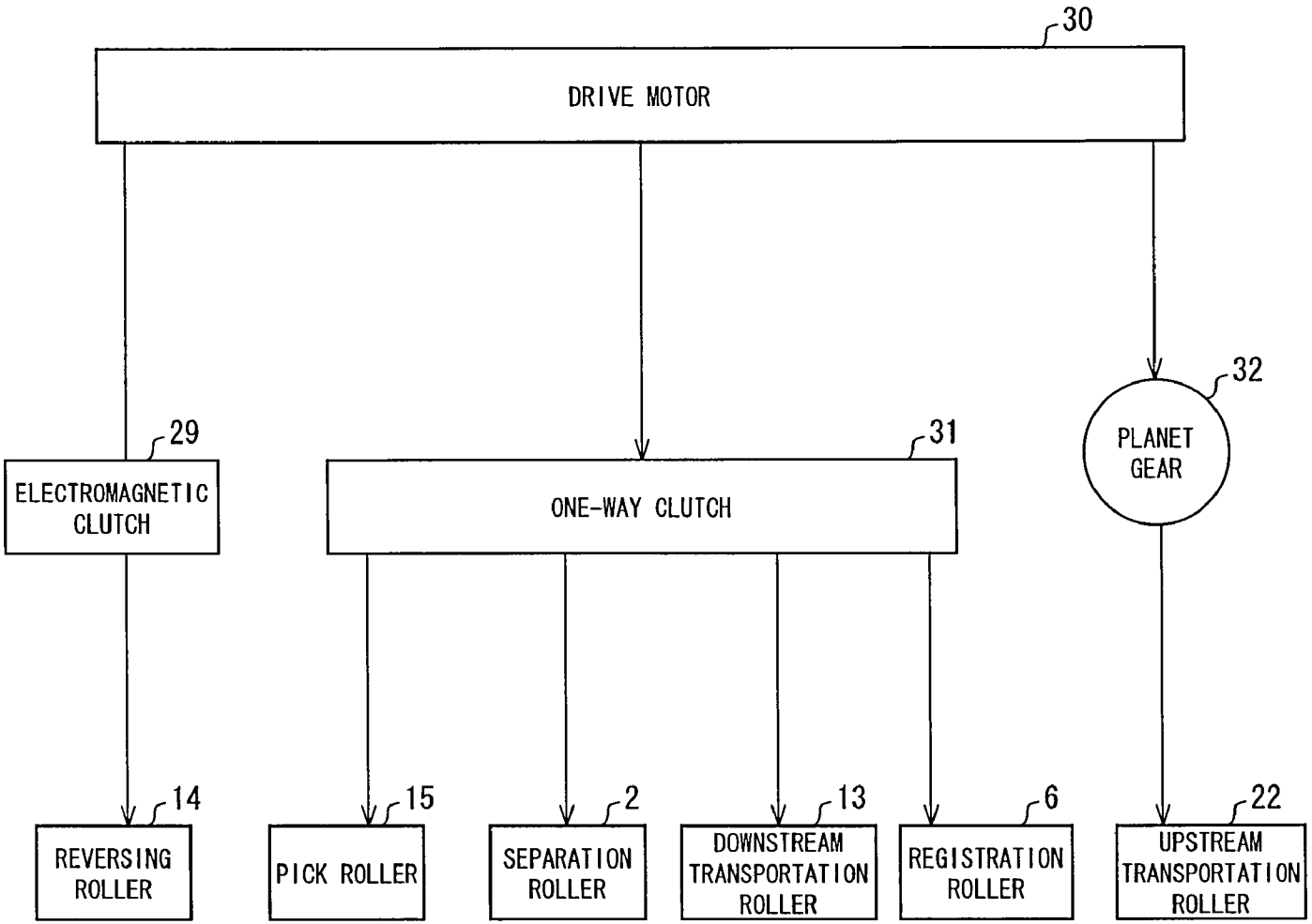
FIG. 3 is a tree diagram showing a configuration of a drive transmission mechanism of the document transportation apparatus.

Next, referring to FIG. 3, a configuration of a drive transmission mechanism in the document transportation apparatus 100 is described. FIG. 3 is a tree diagram showing a configuration of a drive transmission mechanism of the document transportation apparatus 100.

In the document transportation apparatus 100, a driving force (first driving force) from a shared drive motor (driving source) 30 is transmitted to the pick roller 15, the separation roller 2, the downstream transportation roller 13, the registration roller 6, the upstream transportation roller 22 and the reversing roller 14 via a transmission mechanism (not illustrated). In FIG. 3, transmission directions of the driving force are shown with arrows.

The drive motor 30 is rotatable both forwardly and reversely. Whether the drive motor 30 rotates forwardly or reversely is controlled by a main control unit 41 described later (refer to FIG. 4). The driving force from the drive motor 30 is transmitted via an electromagnetic clutch 29 and hereby the reversing roller 14 rotates forwardly or reversely according to a rotation direction of the drive motor 30.

The driving force from the drive motor 30 is transmitted to the pick roller 15, the separation roller 2, the downstream transportation roller 13, and the registration roller 6 via a one-way clutch 31. The one-way clutch 31 transmits the driving force only when the drive motor 30 rotates forwardly. For this reason, the driving force is transmitted to the pick roller 15, the separation roller 2, the downstream transportation roller 13, and the registration roller 6 only when the drive motor 30 rotates forwardly.

Furthermore, the driving force from the drive motor 30 is transmitted to the upstream transportation roller 22 via a planet gear apparatus 32. The planet gear apparatus 32 drives the upstream transportation roller 22 in the same direction (document transportation direction) whether the drive motor 30 rotates forwardly or reversely. A mechanism of the planet gear apparatus 32 is described later.

Figure 4:
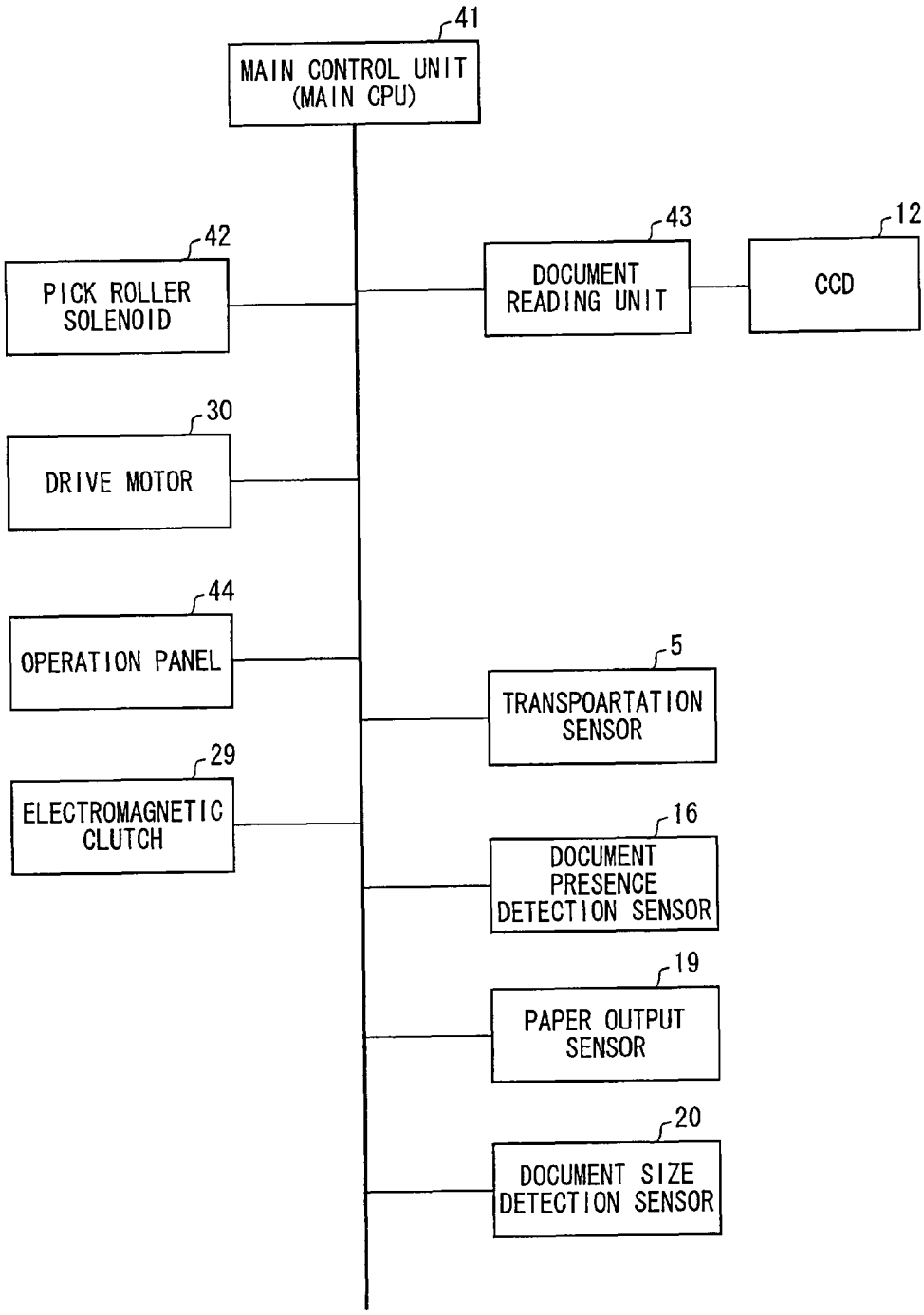
FIG. 4 is a block diagram showing a configuration of a control system of the document transportation apparatus.

Next, referring to FIG. 4, a control system of the document transportation apparatus 100 is described. FIG. 4 is a block diagram showing a configuration of a control system of the document transportation apparatus 100.

A main control unit (main CPU) 41 is a control center of the document transportation apparatus 100. When instructions to read a document are given by an operation panel 44, the main control unit (main CPU) 41 carries out a flow shown in FIG. 5 described later by controlling a pick roller solenoid 42, the drive motor 30, a document reading unit 43, the CCD 12 and the electromagnetic clutch 29 on the basis of each detection output of the transportation sensor 5, the document presence detection sensor 16, the paper output sensor 19 and the document size detection sensor 20.

The pick roller solenoid 42 makes the pick roller 15 away from or in contact with the document by turning the pick arm 23. The document reading unit 43 comprises the light source lamp 9, a plurality of the mirrors 10 . . . , the lens 11 and so forth which are illustrated in FIG. 2. The document reading unit 43 is intended to obtain image data of a document for the CCD 12 by reading image information of the document.

The drive motor 30, as set forth above, is intended to drive the pick roller 15, the separation roller 2, the registration roller 6, the reversing roller 14, the upstream transportation roller 22, and the downstream transportation roller 13. The electromagnetic clutch 29 turns on and off transmission of the driving force from the drive motor 30 to the reversing roller 14.

Figure 5:
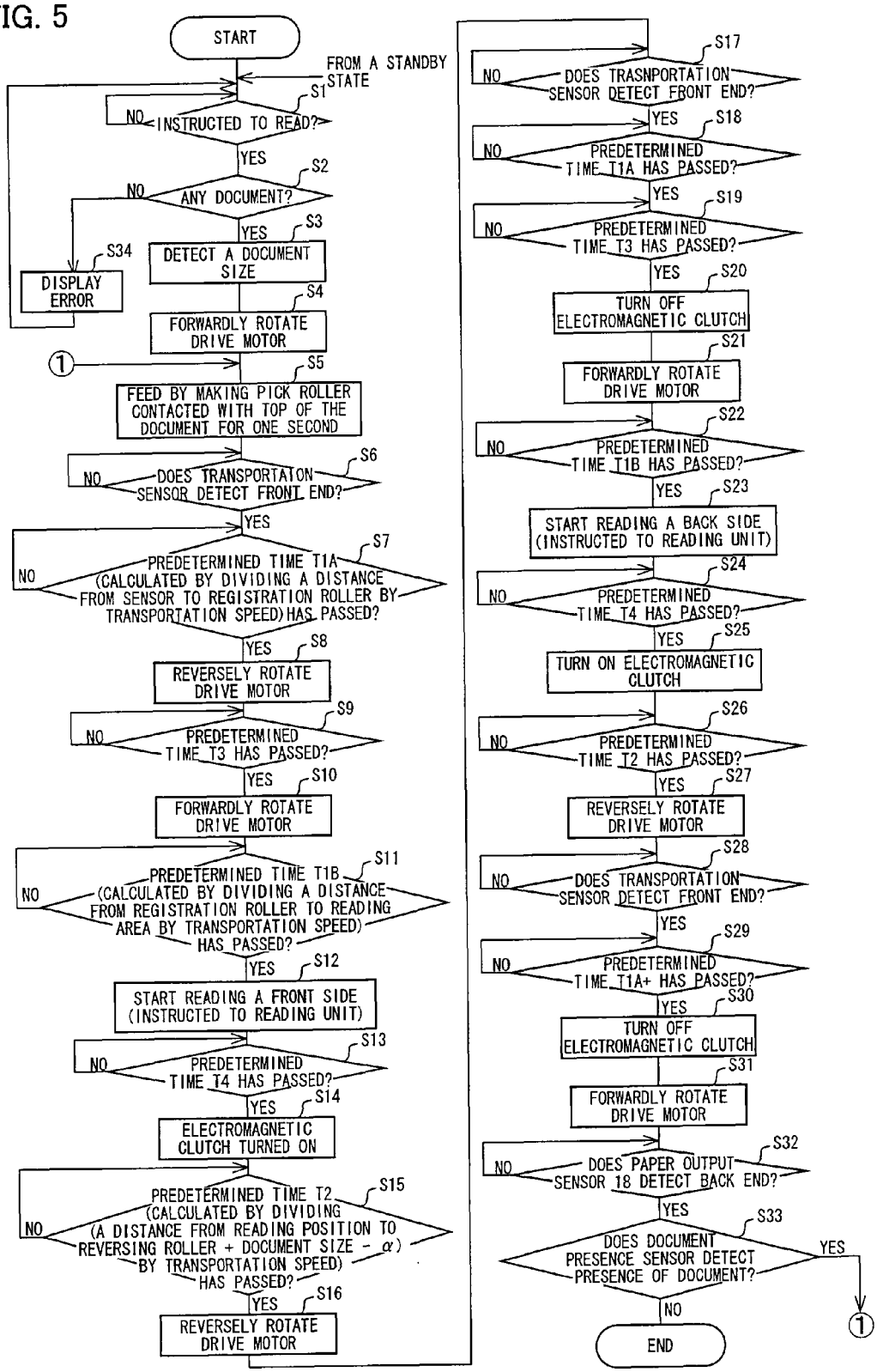
FIG. 5 is a flowchart showing a control procedure for reading of a duplex document in the document transportation apparatus.

Next, referring to FIG. 5, control in the document transportation apparatus 100 in order to read a duplex document is described. FIG. 5 is a flowchart showing a control procedure in order to read a duplex document in the document transportation apparatus 100.

When instructions for reading are given by a button to start reading in the operation panel 44 (Y at S1), the document presence detection sensor 16 detects whether there is a document or not (S2). Here, if there is no document (N at S2), the apparatus gives an error display (S34) and returns to a standby state again.

If there is a document (Y at S2), on the other hand, the document size detection sensor 20 detects a document size (S3) and the drive motor 30 is started to forwardly rotate (in a document transportation direction, first direction) (S4). When the drive motor 30 forwardly rotates, in FIG. 2, the reversing roller 14, the upstream transportation roller 22, the registration roller 6 and the downstream transportation roller 13 rotate clockwise, while the pick roller 15 and the separation roller 2 rotate counterclockwise.

Next, the pick roller solenoid 42 is driven to make the pick roller 15 contacted with a top of a document for one second so as to feed the document (S5). Then the transportation sensor 5 detects the arrival of a front end of the document (a change from a document-free state to a state with a document) (S6).

After the arrival of the front end of the document is detected (Y at S6), the apparatus stands by until a predetermined time T1*a* has passed after the transportation sensor 5 detects the arrival of the front end of the document (S7). The predetermined time T1*a* is a time required for a document to be transported, by the upstream transportation roller 22, for a distance from the transportation sensor 5 to right before a position where the registration roller 6 is pressed. The time is calculated by dividing, by a transportation speed V, the distance from the transportation sensor 5 to right before a position where the registration roller is pressed. At the point of the predetermined time T1*a* having passed, the document is not sandwiched between the registration rollers 6.

After the predetermined time T1*a* has passed (Y at S7), the drive motor 30 is reversely rotated (S8). The reverse rotation of the drive motor 30 causes suspension of the pick roller 15, the separation roller 2, the downstream transportation roller 13 and the registration roller 6, which are connected with the drive motor 30 via the one-way clutch. Moreover, the separation roller 2 rotates together with the document. On the other hand, the upstream transportation roller 22 continues to rotate clockwise (in a document transportation direction) by the planet gear apparatus 32 moving as described later even if the drive motor 30 is reversely rotated. The document continues to be transported by the driving force from the upstream transportation roller 22.

After reversely rotating the drive motor 30, the apparatus stands by for a predetermined time T3 (S9). The document is pressed on the suspended registration roller 6 where the front end of the document is curved for adjustment. After the predetermined time T3 has passed (y at S9), the registration roller 6 is redriven by forwardly rotating the drive motor 30 (S10).

Next, the apparatus further stands by until a predetermined time T1*b* has passed (S11). The predetermined time T1*b* is a time required for the document to be transported for a distance from the registration roller 6 to a reading area of the document reading unit 43. The predetermined time T1*b* is calculated by dividing the distance from the registration roller 6 to the reading area by the transportation speed V.

After the predetermined time T1*b* has passed (Y at S11), the apparatus instructs the document reading unit 43 to start reading a front side of the document (S12). At this point, based on the instruction, the document reading unit 43 performs data reading as much as the document size.

After that, at the timing of a predetermined time T4 having passed from the start of reading of the front side (Y at S13), the electromagnetic switch 29 is turned on (S14). The predetermined time T4 is calculated by dividing a distance from a reading position to the downstream transportation roller 13 by the transportation speed V. Therefore, it is possible to start rotating the reversing roller 14 when the front end of the document reaches the downstream transportation roller 13.

Then the apparatus further stands by until a predetermined time T2 has passed from the start of reading of the front side (S15). After the predetermined time T2 has passed, the drive motor 30 is reversely rotated (S16). The predetermined time T2 is calculated by dividing (a distance L2 from the reading position to the reversing roller 14+a document size−α) by the transportation speed V. Here, a document size is a length of a document transportation direction. Furthermore, α is equivalent to a distance from a position where the reversing roller is pressed to a rear end of the document when the reversing roller 14 sandwiches the rear end part of the document. If the document is transported for the distance L2 from the reading position to the reversing roller 14+a document size, the document will be outputted to the paper output tray 17. Therefore, the length α (10 mm or so) is deducted so that the document will not be outputted.

When the front end of the document is detected by the transportation sensor 5 again (S17) after the drive motor 30 is reversely rotated, the apparatus stands by until the predetermined time T1*a* has passed (S18), as set forth above.

After the predetermined time T1*a* has passed, the apparatus stands by for the predetermined time T3 (S19). Then the document is pressed on the suspended registration roller 6 where the front end of the document is curved for adjustment. Then the electromagnetic clutch 29 is turned off (S20). A length of a transportation pathway is set such that when a front end of a document of the maximum length reaches the upstream transportation roller 22, a rear end of the document will pass through the reversing roller 14. Therefore, at the point of the rear end of the document having passed through the reversing roller 14, it is possible to switch the reverse rotation of the drive motor 30 for reversely rotating the reversing roller 14 to forward rotation.

After that, the drive motor 30 is switched to forwardly rotate (S21). As set forth above, the apparatus further stands by until the predetermined time T1*b* has passed (S22). Moreover, after the predetermined time T1*b* has passed, the front end of the document has reached the reading area. Therefore, the apparatus instructs the document reading unit 43 to start reading a back side of the document.

In this way, when the drive motor 30 reversely rotates after S16, the reversing roller 14 rotates counterclockwise, while the upstream transportation roller 22 rotates clockwise. The registration roller 6 and the downstream transportation roller 13 are suspended with no driving force being transmitted by the one-way clutch 31 when the drive motor 30 reversely rotates. When the document reaches the registration roller 6, the drive motor 30 forwardly rotates again and hereby the document is transported to the reading area of the document reading unit 43 again. Then the document reading unit 43, based on the instruction, implements reading of data of the document size. Hereafter, the processing from S24 to S28 is identical to that from S13 to S17.

Next, the apparatus stands by until a predetermined time T1*a*+ has passed (S29). The predetermined time T1*a* is a time required for the document to be transported, by the upstream transportation roller 22, a distance from the transportation sensor 5 to a position where the registration roller 6 is pressed. The predetermined time T1*a* is calculated by dividing, by the transportation speed V, the distance from the transportation sensor 5 to the position where the registration roller 6 is pressed. At the point of the predetermined time T1*a*+ having passed, the front end of the document has reached the registration roller 6. Because the front end of the document is sandwiched between the registration rollers 6, the apparatus turns off the electromagnetic clutch 29 (S30) and switches the drive motor 30 to a forward rotation (S31).

After that, when the rear end of the document (a change from a state with a document to a document-free state) is detected by the paper output sensor 19 (S32), the apparatus judges that the document has been outputted and proceeds to control transportation of the next document. In the same way as S2, the document presence detection sensor 16 detects whether there is a document or not (S33). Here, if a state with a document is detected by the document presence detection sensor 16 (Y at S33), the apparatus returns to S5 again and continues the processing. If there is no document (N at S33), the apparatus terminates the processing.

Moreover, the above describes control at the time of duplex reading. As for control at the time of one-side reading, the apparatus is controlled so as to proceed to S32 after S12.

Figure 6:
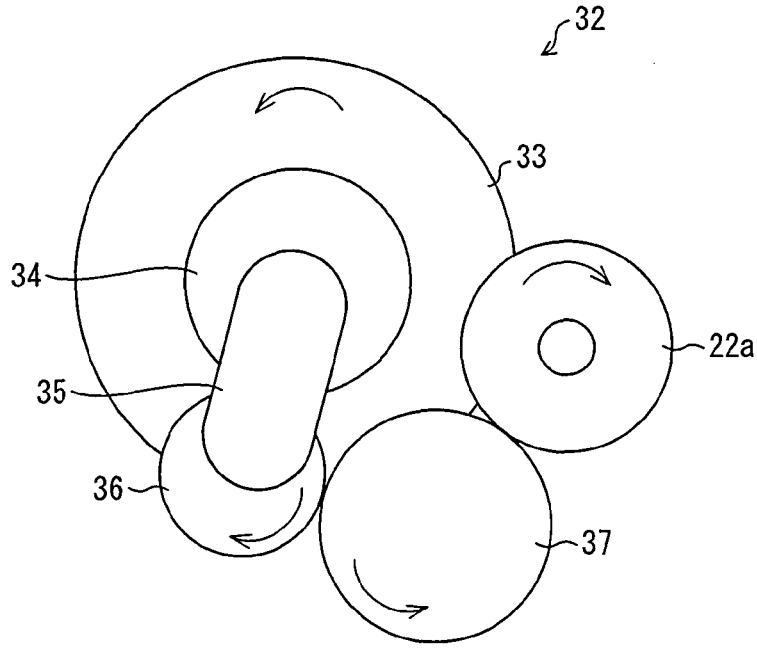
FIG. 6(*a*) is an explanatory view showing a drive state of a planet gear apparatus and an upstream transportation roller gear during normal transportation in which a drive motor provided in the document transportation apparatus forwardly rotates.
Figure 6:
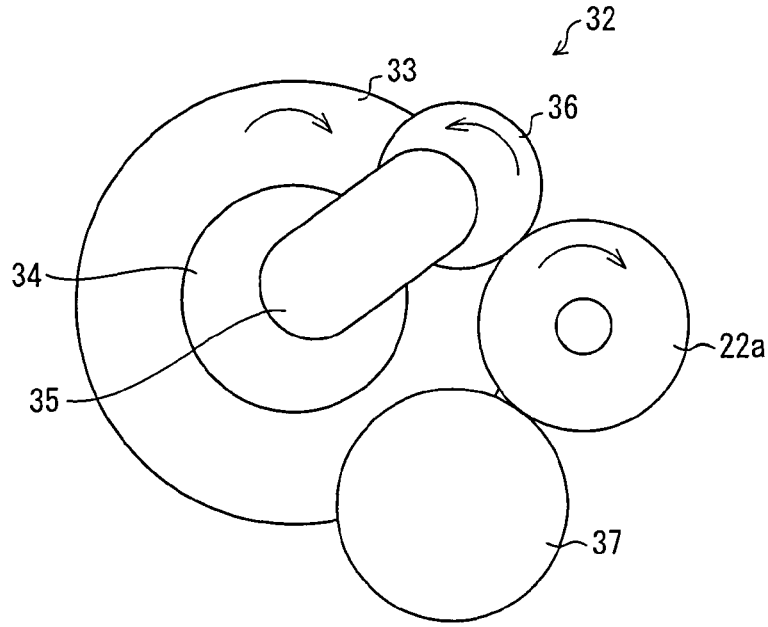
Figure 7:
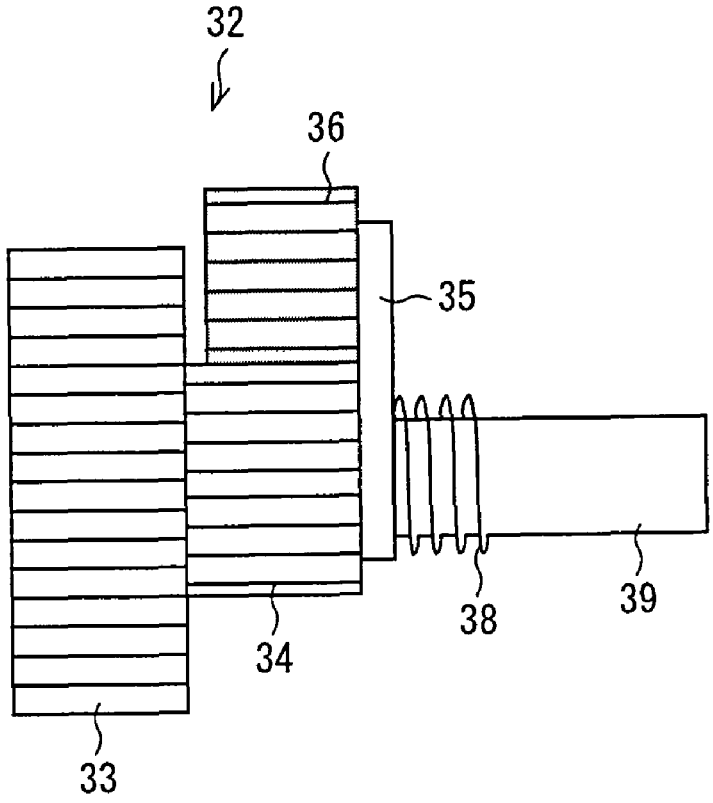
FIG. 7 is a side view of the planet gear apparatus provided in the document transportation apparatus.

Next, referring to FIGS. 6(*a*), 6(*b*) and 7, the following describes a planet gear apparatus 32 and a mechanism for constantly rotating the upstream transportation roller 22 in the same direction regardless of a rotation direction of the drive motor 30 by using the planet gear apparatus 32. FIG. 6(*a*) is an explanatory view showing a drive state of the planet gear apparatus 32 and the upstream transportation roller gear 22*a* during normal transportation in which the drive motor 30 forwardly rotates. FIG. 6(*b*) is an explanatory view showing a drive state of the planet gear apparatus 32 and the upstream transportation roller gear 22*a* during reverse transportation in which the drive motor 30 reversely rotates. Further, FIG. 7 is a side view of the planet gear apparatus 32.

The planet gear apparatus 32 comprises a planet gear first drive gear 33, a planet gear second drive gear 34, a planet gear arm 35, a planet gear 36, and a spring 38.

The driving force from the drive motor 30 is transmitted to the planet gear first drive gear 33. the planet gear first drive gear 33 is coaxial with the planet gear second drive gear 34. The planet gear first drive gear 33 and the planet gear second drive gear 34 are integrally driven.

The planet gear 36 is provided on a circumference of the planet gear second drive gear 34. The planet gear 36 is rotatably supported by one end of the planet gear arm 35. The other end of the planet gear arm 35 is rotatably supported by a supporting shaft 39 of the planet gear second drive gear 34 and at the same time pressed on the planet gear second drive gear 34 by the spring 38. This allows the planet gear arm 35 to rotate together with a rotation of the planet gear second drive gear 34. The planet gear 36 also moves together with the rotation of the planet gear second drive gear 34 with itself and the planet gear second drive gear 34 engaging with each other.

The planet gear 36 engages with the upstream transportation roller gear 22*a* which is a drive gear of the upstream transportation roller 22 or an intermediate gear 37 which engages with the upstream transportation roller gear 22*a* according to a rotation direction of the planet gear second drive gear 34. The planet gear 36 transmits the driving force transmitted to the planet gear first drive gear 33 to the upstream transportation roller gear 22*a* or the intermediate gear 37.

As illustrated in FIG. 6(*a*), during normal transportation (in which the drive motor 30 forwardly rotates), the planet gear first drive gear 33 and the planet gear second drive gear 34 rotate counterclockwise in FIG. 6(*a*). The planet gear 36 also moves counterclockwise with the circumference of the planet gear second drive gear 34 so as to abut on and engage with the intermediate gear 37. By the planet gear 36 abutting on the intermediate gear 37, the planet gear 36 rotates clockwise so as to rotate the intermediate gear 37 counterclockwise. By the intermediate gear 37 being rotated counterclockwise, the upstream transportation roller gear 22*a* engaging with the intermediate gear 37 rotates clockwise. This thus rotates the upstream transportation roller 22 clockwise.

In reverse transportation (in which the drive motor 30 reversely rotates), on the other hand, as illustrated in FIG. 6(*b*), the planet gear first drive gear 33 and the planet gear second drive gear 34 rotate clockwise in FIG. 6(*b*). The planet gear 36 also moves clockwise with the circumference of the planet gear second drive gear 34 so as to abut on and engage with the upstream transportation roller gear 22*a*. By the planet gear 36 abutting on the upstream transportation roller gear 22*a*, the planet gear 36 rotates counterclockwise so as to rotate the upstream transportation roller gear 22*a* clockwise. This thus rotates the upstream transportation roller 22 clockwise.

In this way, the planet gear apparatus 32 makes it possible to rotate the upstream transportation roller 22 unidirectionally (clockwise) whether the drive motor 30 rotates forwardly or reversely.

Figure 8:
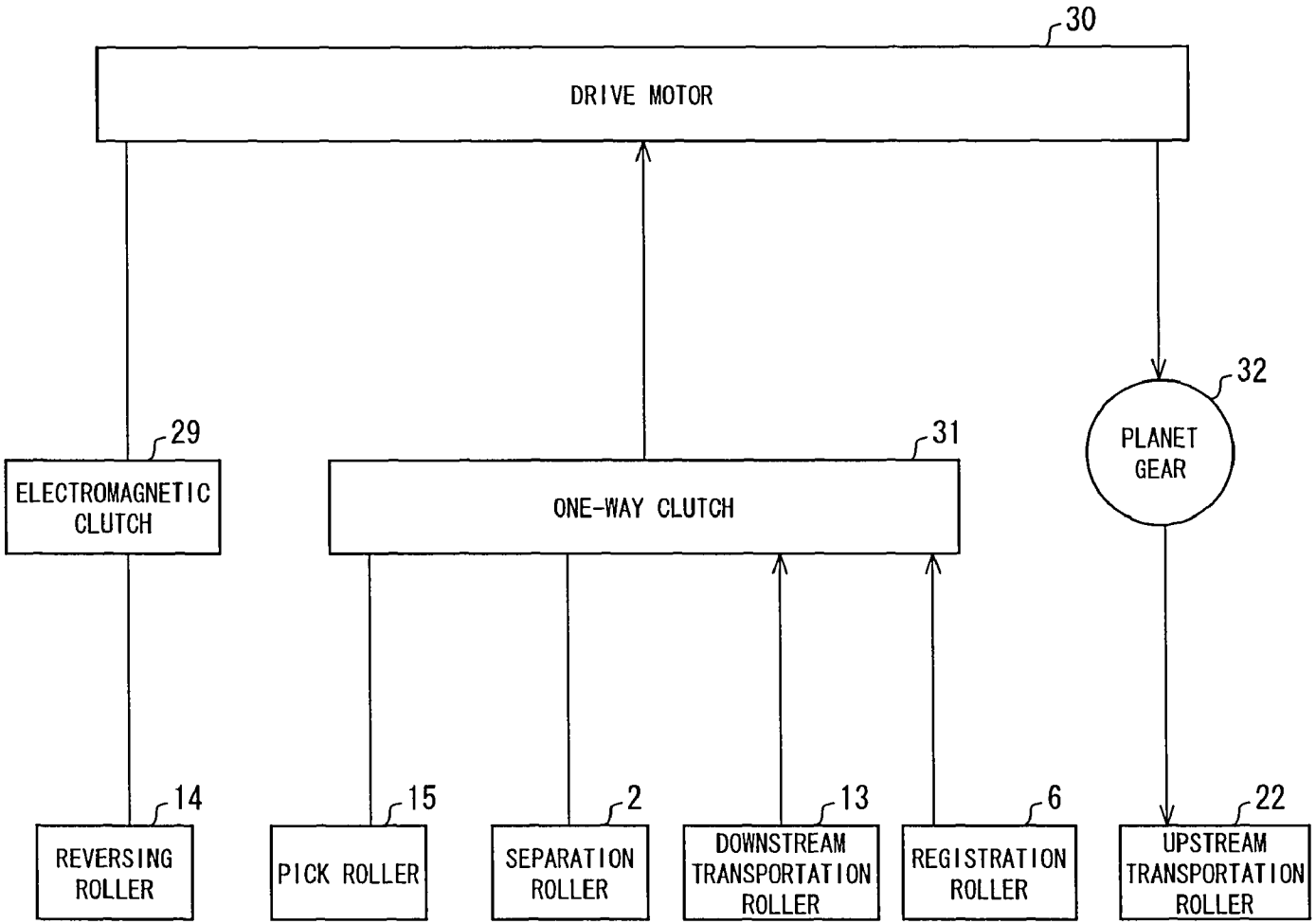
FIG. 8 is a tree diagram showing how a force to pull out a document is transmitted to a drive transmission mechanism in the document transportation apparatus.

Next, referring to FIG. 8, the following describes a state where a jammed document is pulled out from the document transportation apparatus 100 in a document jam. FIG. 8 is a tree diagram showing the way a force to pull out a document is transmitted to a drive transmission mechanism in the document transportation apparatus 100. In FIG. 8, in which direction the driving force by human power is transmitted, is shown with arrows.

When a document jam occurs, a user opens an exterior cover of the document transportation apparatus 100 and tries to pull out a rear end of the jammed document left on the document tray 1. By pulling out the document, the upstream transportation roller 22 receives the driving force to rotate counterclockwise (in a direction opposite to a document transportation direction) by human power.

The driving force to rotate counterclockwise (in a direction opposite to a document transportation direction) is also given to the registration roller 6 and the downstream transportation roller 13 by human power for pulling out the document. This makes the registration roller 6 and the downstream transportation roller 13 reversely rotate the drive motor 30 via the one-way clutch 31.

The reverse rotation of the drive motor 30 causes the same state as that of the reverse transportation illustrated in FIG. 6(*b*). That is, the planet gear first drive gear 33 rotates clockwise. Therefore, the planet gear 36 also moves clockwise together with the planet gear second drive gear 34 rotating clockwise and abuts on the upstream transportation roller gear 22*a* so as to rotate the upstream transportation roller 22 clockwise.

Therefore, even if the user tries to rotate the upstream transportation roller 22 counterclockwise by pulling out the document, the planet gear 36 abuts on the upstream transportation roller gear 22*a*, so that a clockwise rotation of the planet gear trying to rotate the upstream transportation roller 22 clockwise prevents the document from being pulled out.

In order to solve such a problem that it is impossible to pull out a document, the document transportation apparatus 100 of the present embodiment is configured such that, a release mechanism 50 is provided. The release mechanism 50 releases the engagement of the planet gear 36 with the upstream transportation roller gear 22*a* when a jammed document is pulled out.

Figure 1:
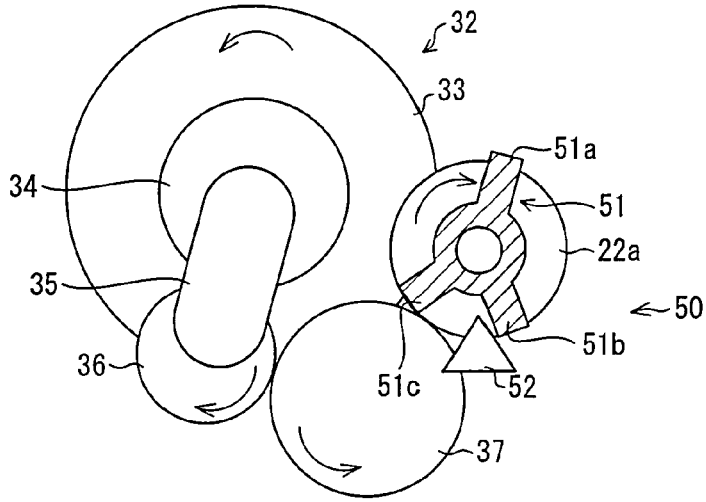
FIGS. 1(*a*) to 1(*c*) all show one embodiment of the present invention. Specifically, FIG. 1(*a*) is an explanatory view showing a drive state of a planet gear apparatus and an upstream transportation roller gear and a state of a release mechanism during normal transportation in which a drive motor provided in a document transportation apparatus forwardly rotates.
Figure 1:
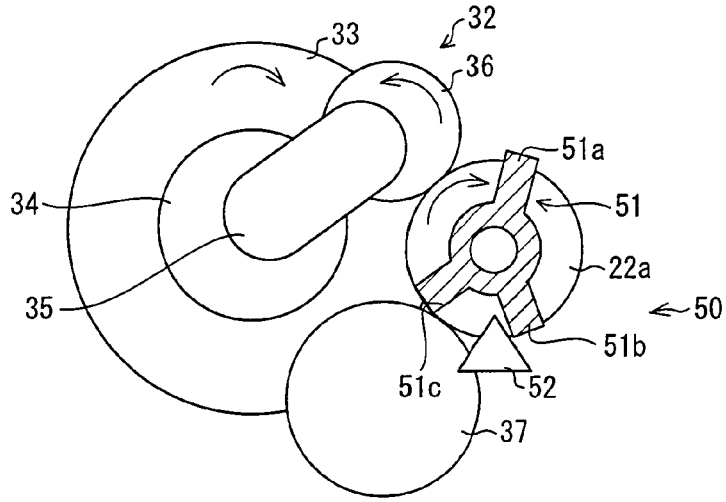
Figure 1:
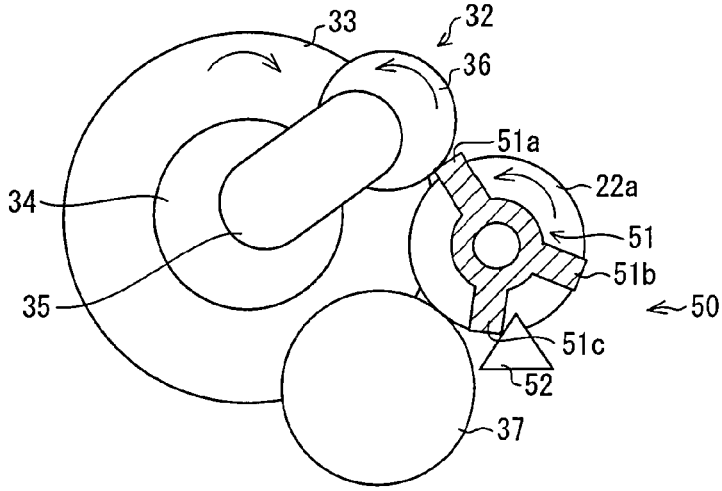

Referring to FIGS. 1(*a*) to 1(*c*), the release mechanism 50 for releasing the engagement of the planet gear 36 with the upstream transportation roller gear 22*a* is described. FIG. 1(*a*) is an explanatory view showing a drive state of the planet gear apparatus 32 and the upstream transportation roller gear 22*a* and a state of the release mechanism 50 during normal transportation in which the drive motor 30 forwardly rotates. FIG. 1(*b*) is an explanatory view showing a drive state of the planet gear apparatus 32 and the upstream transportation roller gear 22*a* and a state of the release mechanism 50 during reverse transportation in which the drive motor 30 reversely rotates. FIG. 1(*c*) is an explanatory view showing a drive state of the planet gear apparatus 32 and the upstream transportation roller gear 22*a* and a state of the release mechanism 50 at the time of jam release.

When the upstream transportation roller gear (driven gear) 22*a* is driven to reversely rotate by the second driving force, the release mechanism 50 prevents the planet gear and the driven gear from engaging with each other by moving a release member before the planet gear and the driven gear engage with each other. The release member is moved by the driven gear being reversely rotated by a second driving force. The second driving force is a driving force other than the first driving force.

Here the second driving force is, for example, human power trying to pull out a document sandwiched between the transportation rollers in a direction opposite to a document transportation direction. According to this, the engagement of the planet gear 36 with the upstream transportation roller gear 22*a* is released by using the upstream transportation roller gear 22*a* being reversely rotated by human power provided for removing a document.

Specifically, the release mechanism 50 of the present embodiment comprises a release member (first release member) 51 for releasing the engagement of the planet gear 36 with the upstream transportation roller gear 22*a* by being moved by the upstream transportation roller gear 22*a* being reversely rotated before the planet gear 36 and the upstream transportation roller gear 22*a* engage with each other by human power trying to pull out a document.

The release member 51 is coaxial with the upstream transportation roller gear 22*a*. The release member 51 is configured to rotate together with a rotation of the upstream transportation roller gear 22*a* by a frictional force and has 3 projections 51*a* to 51*c*. Of these projections, the protrusion 51*a* whose tip portion is extended outside the circumference of the upstream transportation roller gear 22*a* disengages the planet gear 36 away from the upstream transportation roller gear 22*a* by making the tip portion abut on the planet gear 36. The other two protrusions 51*b* and 51*c* regulate a range within which the release member 50 rotates together with the upstream transportation roller gear 22*a* by engagement with a regulation member 52. A rotation regulation unit is constituted by the other two protrusions 51*b* and 51*c* and the regulation member 52.

As illustrated in FIGS. 1(*a*) and 1(*b*), the upstream transportation roller gear 22*a* is rotated clockwise both during normal transportation (in which the drive motor 30 forwardly rotates) and during reverse transportation (in which the drive motor 30 reversely rotates). Therefore, the release member 51 rotating together with the upstream transportation roller gear 22*a* also rotates clockwise. The clockwise rotation of the release member 51 is regulated by the regulation member 52 abutting on the protrusion 51*b*.

In this state, the protrusion 51*a* of the release member 51 is not contacted with the planet gear 36. This thus enables the planet gear 36 to transmit the driving force to the intermediate gear 37 or to the upstream transportation roller gear 22*a*.

Then as illustrated in FIG. 1(*c*), at the time of jam release, the upstream transportation roller 22 rotates together with a document being pulled out in an opposite direction from a document transportation direction and thus the upstream transportation roller gear 22*a* rotates counterclockwise. The release member 51 also rotates counterclockwise together with the rotation of the upstream transportation roller gear 22*a*. A tip portion of the protrusion 51*a* moves to an abutting position with the planet gear 36. On the other hand, as the planet gear second drive gear 34 rotates clockwise, the planet gear 36 is away from the intermediate gear 37 and moves clockwise with the circumference of the planet gear second drive gear 34 so as to abut on and engage with the upstream transportation roller gear 22*a*. However, the planet gear 36 abuts on the protrusion 51*a* before abutting on the upstream transportation roller 22*a*. Therefore, the engagement of the planet gear 36 with the upstream transportation roller 22*a* is prevented.

This makes it possible to easily pull out a jammed document without the upstream transportation roller gear 22*a* being prevented from rotating counterclockwise by the planet gear 36.

Moreover, further rotation of the release member 51 after having moved to an abutting position with the planet gear 36 is regulated by the regulation member 52 abutting on the protrusion 51*c*.

As set forth above, in the document transportation apparatus 100 of the present embodiment, the release mechanism 50 prevents the planet gear 36 and the upstream transportation roller gear 22*a* from engaging with each other by moving the release member 51 before the planet gear 36 and the upstream transportation roller gear 22*a* engage with each other with the use of the upstream transportation roller gear 22*a* being reversely rotated by human power trying to pull out a document sandwiched between the transportation rollers in a direction opposite to a document transportation direction. This makes it possible to release the engagement of the planet gear first drive gear 33 to which the driving force from the drive motor 30 is transmitted, precisely of the planet gear second drive gear 34, with the upstream transportation roller 22*a* without reversely rotating the drive motor 30 or impairing the driving force from the drive motor 30.

Furthermore, it is preferable that such a release member 51 rotating together with the upstream transportation roller gear 22*a* be configured to be contacted with the upstream roller gear 22*a* so as to rotate together therewith only at the time of jam release. However, in order to configure the release member 51 to rotate together with the upstream roller gear 22*a*, it is necessary to provide a spring or the like for making the release member 51 abut on the upstream transportation roller gear 22*a* only at the time of jam release. Therefore, a mechanism will be complicated.

On the other hand, by providing the rotation regulation unit, including the regulation member 52 for regulating a range within which the release member 51 rotates together with the driven gear as set forth above, it is possible to easily avoid a problem caused by the release member constantly rotating together with the driven gear without providing a complicated mechanism, such as a spring or the like.

Figure 9:
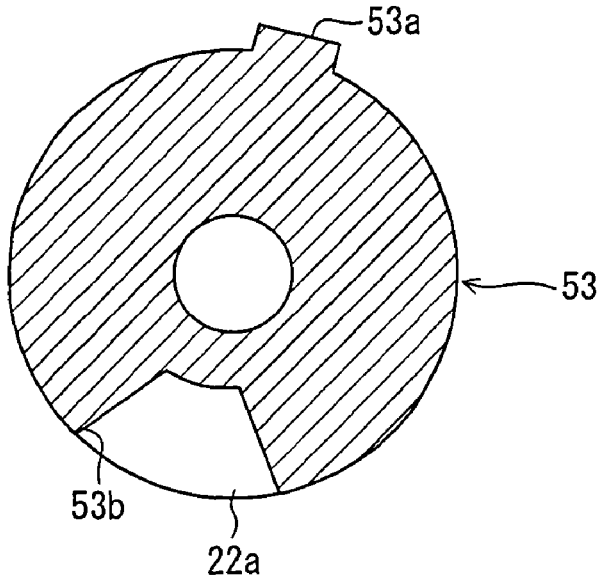
FIGS. 9(*a*) and 9(*b*) are both explanatory views showing another shape of a release member provided in a release mechanism of the document transportation apparatus.
Figure 9:
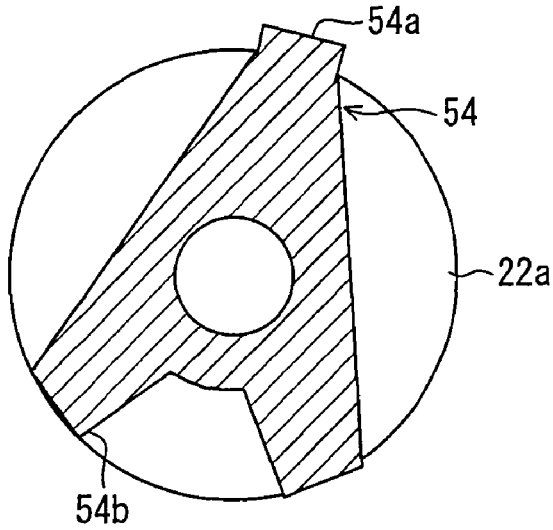

Moreover, a configuration of a release member is not limited to that of the release member 51 illustrated in FIGS. 1(*a*) to 1(*c*) but rather may also be release members 53 and 54 in such a form as illustrated in FIGS. 9(*a*) and 9(*b*). That is, a release member may be configured such that a release member has abutting parts 53*a* and 54*a* extended outside the circumference of the upstream transportation roller gear 22*a* as well as engagement parts 53*b* and 54*b* engaging with the regulation member 52 so as to regulate a rotation of the release members 53 and 54. FIGS. 9(*a*) and 9(*b*) are explanatory views showing another form of a release member.

Furthermore, the release member 51 is configured such that the tip portion of the protrusion 51*a* prevents the planet gear 36 and the upstream transportation roller gear 22*a* from engaging with each other by abutting on the planet gear 36. However, the release member 51 can be configured such that the release member 51 prevents the planet gear 36 and the upstream transportation roller gear 22*a* from engaging with each other by abutting on the circumference of the supporting shaft rotatably supporting the planet gear 36.

According to this, the release member 51 is not directly contacted with the planet gear 36. Therefore, it is possible to effectively prevent the tip portion of the protrusion 51*a* from being worn by a contact with the planet gear 36.

Figure 10:
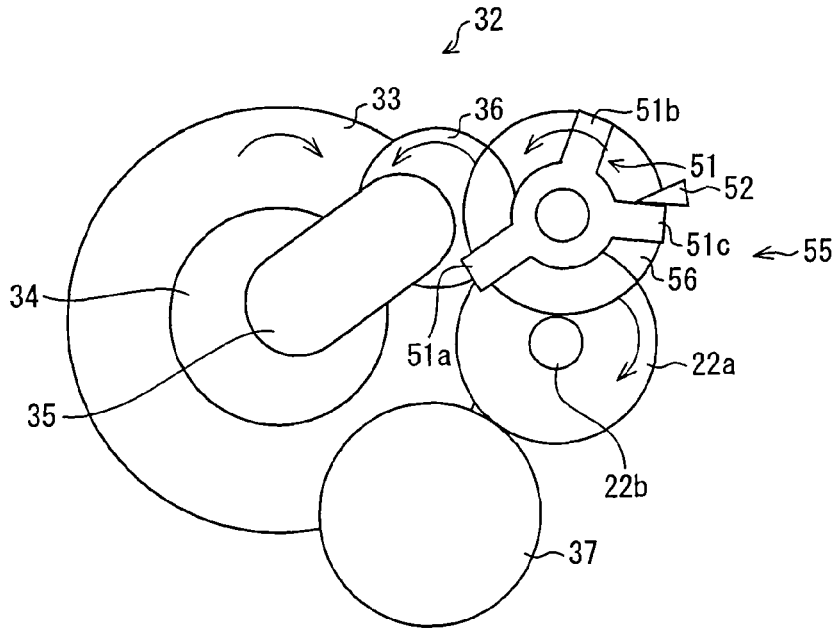
FIGS. 10(*a*) and 10(*b*) both show another embodiment of the present invention. Specifically, FIG. 10(*a*) is an explanatory view showing a drive state of a planet gear apparatus and an upstream transportation roller gear and a state of a release mechanism during normal transportation in which a drive motor provided in a document transportation apparatus forwardly rotates.
Figure 10:
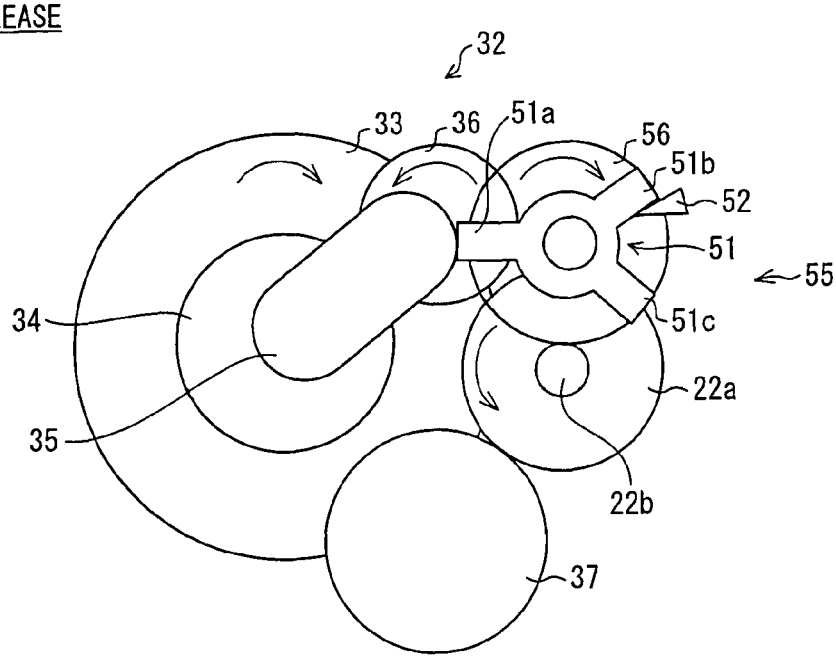

A configuration such that the release member 51 is coaxial with the upstream transportation roller gear 22*a* is illustrated here, but it is also possible to configure such a release mechanism 55 as illustrated in FIGS. 10(*a*) and 10(*b*).

FIG. 10(*a*) is an explanatory view showing a drive state of the planet gear apparatus 32 and the upstream transportation roller gear 22*a* and a state of the release mechanism 55 during normal transportation in which the drive motor 30 forwardly rotates. FIG. 10(*b*) is an explanatory view showing a drive state of the planet gear apparatus 32 and the upstream transportation roller gear 22*a* and a state of the release mechanism 55 at the time of jam release. Moreover, for simple description, description of members having the same functions as those used in the first embodiment is omitted by labeling the members in the same fashion.

In the release mechanism 55, the release member 51 (or 53, 54) is provided on a shaft of another rotation member 56 which is contacted with a shaft 22*b* of the upstream transportation roller gear 22*a* (which may be contacted with the upstream transportation roller 22*a*) so as to rotate together with the upstream transportation roller gear 22*a*.

According to this, the release member 51 (or 53, 54) is provided on a shaft other than the upstream transportation roller gear 22*a*. Therefore, this makes it possible to provide a member more flexibly as compared with a configuration such that the release member 51 (or 53, 54) is coaxial with the upstream transportation roller gear 22*a*. For example, even if space for providing the regulation member 52 constituting the rotation regulation unit cannot be secured around the upstream transportation roller gear 22*a*, by adopting the configuration of the release mechanism 55, it is possible to provide a rotation regulation unit with no problem.

Furthermore, the release mechanism 55 illustrated in FIGS. 10(*a*) and 10(*b*) adopts the aforementioned configuration to disengage the planet gear 36 away by making the tip portion of the protrusion 51*a* of the release member 51 abut on the circumference of the supporting shaft rotatably supporting the planet gear 36.

Figure 11:
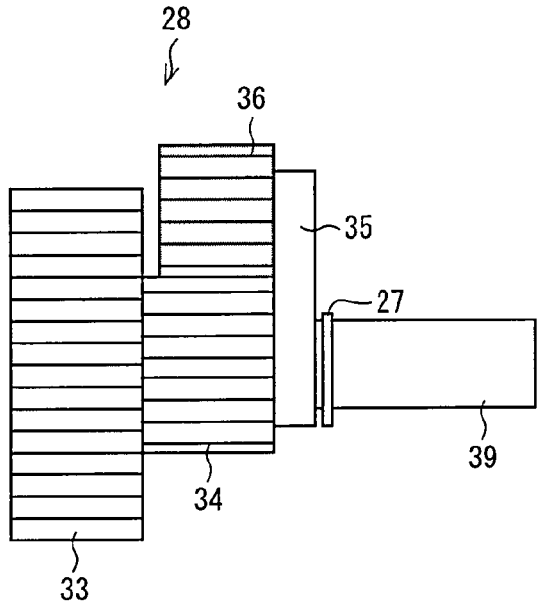
FIGS. 11(*a*) to 11(*c*) are all side views of a planet gear apparatus. The figures show another configuration example of a planet gear apparatus, which can be provided in the document transportation apparatus.
Figure 11:
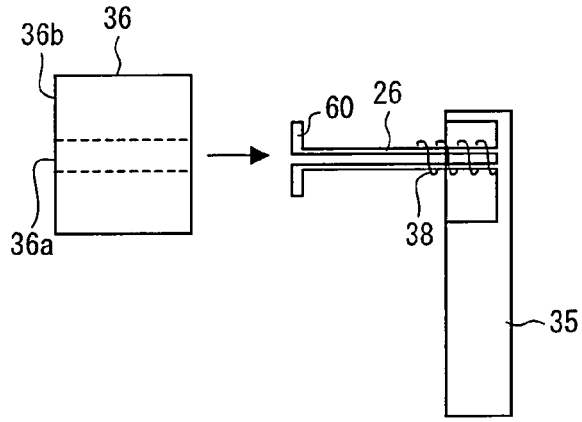
Figure 11:
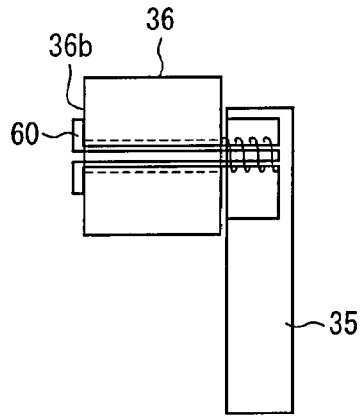

Moreover, FIGS. 11(*a*) to 11(*c*) illustrate another planet gear apparatus 28 which can be used instead of the planet gear apparatus 32. FIGS. 11(*a*) to 11(*c*) are side views of the planet gear apparatus 28. Furthermore, for simple description, description of members having the same functions as those used in the first embodiment is omitted by labeling the members in the same fashion.

The planet gear apparatus 28, in the same way as the planet gear apparatus 32, comprises the planet gear first drive gear 33, the planet gear second drive gear 34, the planet gear arm 35 and the planet gear 36. As illustrated in FIG. 11(*a*), in the planet gear apparatus 28, a clamp rib 27 is provided on the supporting shaft 39 for preventing the planet gear arm 35 from being shifted in a direction toward the shaft. Moreover, as illustrated in FIG. 11(*b*), the planet gear arm 35 is provided with a planet gear rotational shaft 26 penetrating a penetrating hole 36*a* of the planet gear 36 so as to loosely fit the planet gear 36. The planet gear 36, as illustrated in FIG. 11(*c*), is pressed by a spring 38 so that one side surface 36*b* of the planet gear 36 will be contacted with an abutting chip 60 provided at a tip of the planet gear rotational shaft 26 (refer to FIG. 11(*c*)).

The aforementioned configuration, in the same way as the planet gear apparatus 32, enables the planet gear 36 to move around (move on the circumference) in the same direction as a rotation direction of the planet gear second drive gear 34 without spinning freely by the driving force from the planet gear second drive gear 34 at the time of moving around.

The present invention is not limited to the description of the embodiments above, but may be altered by a skilled person within the scope of the claims. An embodiment based on a proper combination of technical means disclosed in different embodiments is encompassed in the technical scope of the present invention.

The drive transmission mechanism of a paper transportation apparatus of the present invention, as set forth above, comprises a driven gear, a planet gear for transmitting a first driving force from a driving source to the driven gear by engagement with the driven gear, and a release mechanism for preventing the planet gear and the driven gear from engaging with each other when the driven gear is driven to reversely rotate by a second driving force. The release mechanism prevents the engagement by moving a release member before the planet gear and the driven gear engage with each other. The release mechanism moves the release member by the driven gear being reversely rotated by the second driving force which is a driving force other than the first driving force.

According to this, the release mechanism is configured to prevent the planet gear and the driven gear from engaging with each other when the driven gear is driven to reversely rotate by the second driving force. The release mechanism prevents the engagement by moving a release member before the planet gear and the driven gear engage with each other. The release mechanism moves the release member by the driven gear being reversely rotated by a second driving force which is a driving force other than the first driving force obtained from the driving source.

Therefore, it is possible to release the engagement of the driven gear and the drive gear for transmitting the driving force from the driving source to the driven gear, without the need of reversely rotating the driving source or the fear of impairing the driving force from the driving source.

The drive transmission mechanism of a sheet transportation apparatus of the present invention can also be configured such that the release member is coaxial with the driven gear and rotates together with the driven gear by a frictional force.

According to this, the release member coaxial with the driven gear and rotating together with the driven gear by a frictional force releases the engagement of the planet gear with the driven gear by disengaging the planet gear away from the driven gear after moving by the driven gear being driven to reversely rotate by the second driving force.

This makes it possible to easily configure a release mechanism for preventing the planet gear and the driven gear from engaging with each other when the driven gear is driven to reversely rotate by the second driving force, the release mechanism preventing the engagement by moving a release member before the planet gear and the driven gear engage with each other, and the release mechanism moving the release member by the driven gear being reversely rotated by a second driving force which is a driving force other than the first driving force obtained from the driving source.

Furthermore, the drive transmission mechanism of a sheet transportation apparatus of the present invention can be configured such that the release mechanism comprises a release member for releasing the engagement of the planet gear with the driven gear by disengaging the planet gear away from the driven gear after moving by the driven gear being driven to reversely rotate by the second driving force, and the release member is supported by a shaft different from that of the driven gear and rotates together with the driven gear by a frictional force.

According to this, the release member provided on a shaft different from that of the driven gear and rotating together with the driven gear by a frictional force releases the engagement of the planet gear with the driven gear by disengaging the planet gear away from the driven gear after moving by the driven gear being driven to reversely rotate by the second driving force.

This makes it possible to easily configure a release mechanism for preventing the planet gear and the driven gear from engaging with each other when the driven gear is driven to reversely rotate by the second driving force, the release mechanism preventing the engagement by moving a release member before the planet gear and the driven gear engage with each other, and the release mechanism moving the release member by the driven gear being reversely rotated by a second driving force which is a driving force other than the first driving force obtained from the driving source.

Furthermore, the release member provided on a shaft different from that of the driven gear makes it possible to provide a member more flexibly as compared with a configuration wherein a release member is coaxial with a driven gear. For example, it is also easy to provide a rotation regulation unit described later.

Moreover, it is preferable to configure the drive transmission mechanism of a sheet transportation apparatus such that the release mechanism includes a rotation regulation unit for regulating a range within which the release member rotates together with the driven gear.

Where a release member rotates together with the driven gear, it is preferable that the release member be configured to rotate together with the driven gear only at the time of jam release. However, in order to configure a release member to rotate together with the driven gear only at the time of jam release, it is necessary to provide a spring or the like for making the release member contacted with the driven gear only at the time of jam release. Therefore, such a mechanism will be complicated.

On the other hand, by providing the rotation regulation unit for regulating a range within which the release member rotates together with the driven gear so as to regulate a moving range of the release member as set forth above, it is possible to easily avoid a problem caused by a release member constantly rotating together with the driven gear without the need of providing a complicated mechanism, such as a spring or the like.

The drive transmission mechanism of a sheet transportation apparatus of the present invention can also be configured such that the release member disengages the planet gear away from a supporting shaft rotatably supporting the planet gear. The release member disengages the planet gear away from the supporting shaft by abutting on a peripheral edge portion of the supporting shaft.

According to this, it is possible to prevent abutting parts of first and second release members with the planet gear from being worn because the release members do not directly abut on the planet gear.

The drive transmission mechanism of a sheet transportation apparatus of the present invention can be combined with a configuration further comprising an intermediate gear engaging with the driven gear, wherein the planet gear engages with the driven gear when the driving source rotates in a first direction, and the planet gear engages with the intermediate gear when the driving source rotates in a second direction which is an opposite direction from the first direction.

A document transportation apparatus of the present invention, as set forth above, comprises a document tray on which to place a document, a feeding roller for feeding the document on the document tray, and a transportation roller for transporting the fed document. The document transportation apparatus, as a drive transmission mechanism of the transportation roller, further comprises a driven gear, a planet gear for transmitting a first driving force from a driving source to the driven gear by engagement with the driven gear, and a release mechanism for preventing the planet gear and the driven gear from engaging with each other when the driven gear is driven to reversely rotate by the second driving force. The release mechanism prevents the engagement by moving a release member before the planet gear and the driven gear engage with each other. The release mechanism moves the release member by the driven gear being reversely rotated by a second driving force which is a driving force other than the first driving force.

This makes it possible to easily remove a jammed document by releasing the engagement of the driven gear and the drive gear for transmitting the driving force from the driving source to the driven gear, without the need of reversely rotating the driving source or the fear of impairing the driving force from the driving source.

Furthermore, the document transportation apparatus of the present invention can be configured such that the feeding roller is freely movable up and down by being provided at one end of a rotatably-supported arm and the feeding roller is regulated in moving upward by the other end of the arm being contacted with a document transportation pathway, and a roller is provided on the arm which end is contacted with a document transportation pathway.

As compared with a configuration wherein an end of an arm is directly contacted with a document, this makes it possible to carry a document more smoothly because the roller is provided on the rotatable arm for moving the feeding roller up and down which end is contacted with the document transportation pathway. Moreover, also in order to clear a paper jam, it is possible to pull out a jammed document smoothly.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A drive transmission mechanism of a sheet transportation apparatus, comprising:

a driven gear;

a planet gear for transmitting a first driving force from a driving source to said driven gear by engagement with said driven gear; and a release mechanism for preventing said planet gear and said driven gear from engaging with each other when said driven gear is driven to reversely rotate by a second driving force, the release mechanism preventing the engagement by moving a release member before said planet gear and said driven gear engage with each other, and the release mechanism moving the release member by said driven gear being reversely rotated by said second driving force which is a driving force other than said first driving force.

2. The drive transmission mechanism as set forth in claim 1, wherein said release member is coaxial with said driven gear and rotates together with said driven gear by a frictional force.

3. The drive transmission mechanism as set forth in claim 1, wherein said release member is supported by a shaft different from that of said driven gear and rotates together with said driven gear by a frictional force.

4. The drive transmission mechanism as set forth in claim 2, wherein said release mechanism includes a rotation regulation unit for regulating a range within which said release member rotates together with said driven gear.

5. The drive transmission mechanism as set forth in claim 3, wherein said release mechanism includes a rotation regulation unit for regulating a range within which said release member rotates together with said driven gear.

6. The drive transmission mechanism as set forth in claim 1, wherein said release member disengages said planet gear away from said driven gear by abutting on a peripheral edge portion of a supporting shaft rotatably supporting said planet gear.

7. The drive transmission mechanism as set forth in claim 1 further comprising an intermediate gear engaging with said driven gear, wherein:

said planet gear engages with said driven gear when said driving source rotates in a first direction, and the planet gear engages with said intermediate gear when said driving source rotates in a second direction which is an opposite direction from said first direction.

8. A document transportation apparatus comprising:

a document tray on which to place a document;

a feeding roller for feeding the document on said document tray; and a transportation roller for transporting the fed document, said document transportation apparatus further comprising a drive transmission mechanism of said transportation roller, the drive transmission mechanism comprising:

a driven gear;

a planet gear for transmitting a first driving force from a driving source to said driven gear by engagement with said driven gear; and a release mechanism for preventing said planet gear and said driven gear from engaging with each other when said driven gear is driven to reversely rotate by a second driving force, the release mechanism preventing the engagement by moving a release member before said planet gear and said driven gear engage with each other, and the release mechanism moving the release member by said driven gear being reversely rotated by said second driving force which is a driving force other than said first driving force.

9. The document transportation apparatus as set forth in claim 8, wherein said feeding roller is freely movable up and down by being provided at one end of a rotatably-supported arm and the feeding roller is regulated in moving upward by the other end of said arm being contacted with a document transportation pathway, and a roller is provided on said arm which end is contacted with a document transportation pathway.

10. The drive transmission mechanism as set forth in claim 1, wherein:

said driving source is rotatable both forwardly and reversely;

said drive transmission mechanism further includes an intermediate gear engaging with said driven gear, wherein:

said planet gear engages with said driven gear when said driving source rotates in a first direction, and the planet gear engages with said intermediate gear when said driving source rotates in a second direction which is an opposite direction from said first direction;

when said driving source is suspended and said driven gear is driven to reversely rotate by said second driving force in a state where said planet gear and said intermediate gear engage with each other, a force of said driven gear to reversely rotate causes said driving source under suspension to rotate also in said first direction, and this rotation of said driving source in said first direction causes said planet gear to move away from said intermediate gear and engage with said driven gear; and said release mechanism prevents the engagement of said planet gear and said driven gear by moving said release member before said planet gear moves to said driven gear so as to engage with said driven gear.

11. The document transportation apparatus as set forth in claim 8, wherein:

said driving source is rotatable both forwardly and reversely;

said drive transmission mechanism further includes an intermediate gear engaging with said driven gear, wherein:

said planet gear engages with said driven gear when said driving source rotates in a first direction, and the planet gear engages with said intermediate gear when said driving source rotates in a second direction which is an opposite direction from said first direction;

when said driving source is suspended and said driven gear is driven to reversely rotate by said second driving force in a state where said planet gear and said intermediate gear engage with each other, a force of said driven gear to reversely rotate causes said driving source under suspension to rotate also in said first direction, and this rotation of said driving source in said first direction causes said planet gear to move away from said intermediate gear and engage with said driven gear; and said release mechanism prevents the engagement of said planet gear and said driven gear by moving said release member before said planet gear moves to said driven gear so as to engage with said driven gear.

* * * * *